United States Patent [19]

Naylor

[11] Patent Number: 4,700,937

[45] Date of Patent: Oct. 20, 1987

[54] FRONT GAUGE FOR MACHINE TOOL

[76] Inventor: Nelson A. Naylor, 3941 Rocky View Dr., Norco, Calif. 91760

[21] Appl. No.: 846,926

[22] Filed: Apr. 1, 1986

[51] Int. Cl.[4] ..... B26D 7/01

[52] U.S. Cl. ..... 269/304; 83/468; 269/317

[58] Field of Search ..... 269/304, 317, 57; 83/468, 207, 522

[56] References Cited

U.S. PATENT DOCUMENTS

| | | | |
|---|---|---|---|
| 1,755,468 | 4/1930 | Cheshire | 83/468 |
| 2,520,495 | 8/1950 | Dehn | 83/467 R |
| 2,618,300 | 11/1952 | Freudenthaler | 83/468 |
| 3,170,351 | 2/1965 | Krynytzky | 83/468 X |
| 3,176,559 | 4/1965 | Kootz | 83/157 |
| 3,314,322 | 4/1967 | Cutter, Jr. | 83/451 |
| 3,592,095 | 7/1971 | Passa et al. | 269/57 |
| 3,926,081 | 12/1975 | Roberts | 83/96 |
| 4,033,572 | 5/1977 | Cailloux | 269/320 |
| 4,256,000 | 3/1981 | Seidel | 83/468 |
| 4,322,066 | 3/1982 | Disney | 269/304 |
| 4,580,474 | 4/1986 | Bueche, Sr. | 83/468 X |

*Primary Examiner*—Frank T. Yost
*Attorney, Agent, or Firm*—Gordon K. Anderson

[57] ABSTRACT

A front gauge which has a pair of arms (20) attached to a machine tool with a front and rear head assembly movably positioned thereon defining a pair of indexing members (34) providing an adjustable measurement. The head assemblies have a front head (32) connected by springs in bias with a positioning screw (50) to a rear head (40) providing separable adjustment. A manual lever operated pin (56) in the rear head mates with one of a series of holes (22) in the arm furnishing an incremental adjustment of the head to the nearest whole number distance from the tool. The adjusting screw is rotated changing the relationship of the heads a fractional dimension, as read by a dial indicator (64) positioned on one head contiguous with the other, thereby achieving accurate measurable distances from the tool to the gauge overcoming inaccuracies of rear mounted gauges.

6 Claims, 12 Drawing Figures

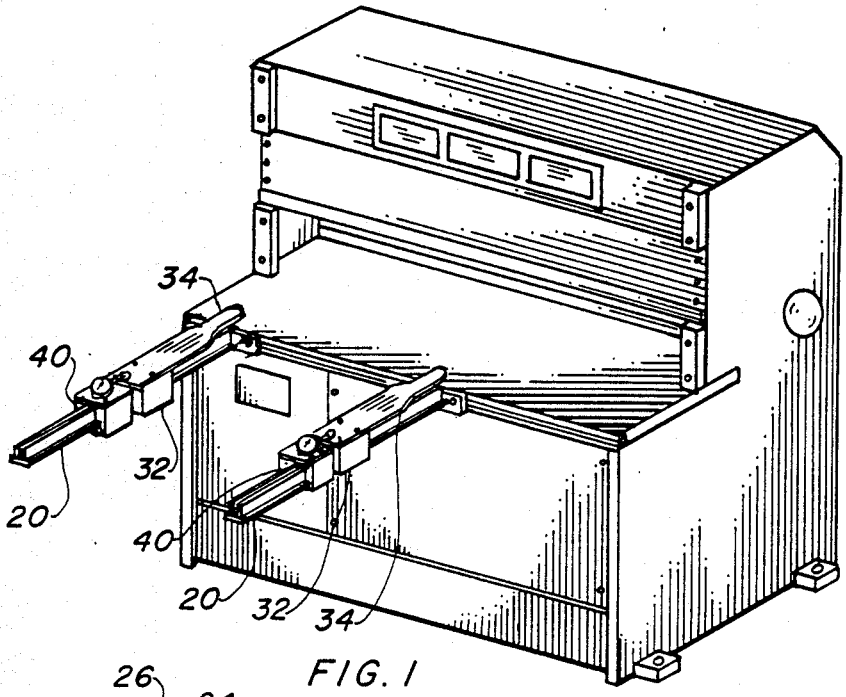
FIG. 1
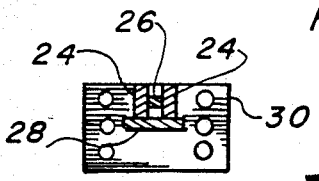
FIG. 2
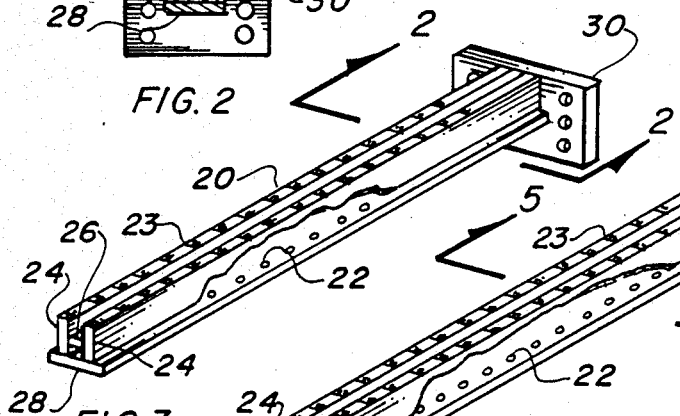
FIG. 3
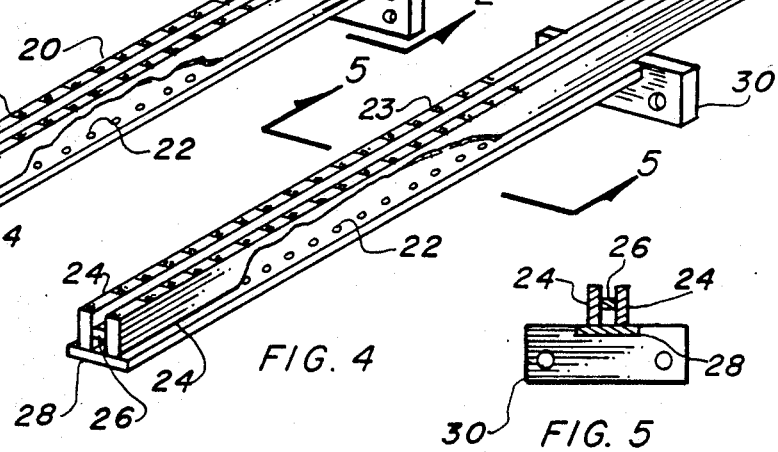
FIG. 4
FIG. 5

FRONT GAUGE FOR MACHINE TOOL

TECHNICAL FIELD

This invention relates in general to measuring and indexing instruments, and more specifically to a front gauge for machine tool shears and brakes with combined internal spacing and dial indicator measured adjustments.

BACKGROUND ART

Previously, many approaches have been taken in endeavoring to provide an accurate means to measure the width of a sheared piece of material or the location of an angular brake. Prior art has been using back gauges for this purpose for some time and a search did not disclose any front gauges at all, however, back gauges may have some of the same elements if not the same utility. The following U.S. patents were at least considered related:

| U.S. Pat. No. | Inventor | Issue Date |
|---|---|---|
| 4,033,572 | Cailloux | July 5, 1977 |
| 3,926,081 | Roberts | Dec. 16, 1975 |
| 3,314,322 | Cutter, Jr. | Apr. 18, 1967 |
| 3,176,559 | Kootz | Apr. 6, 1965 |
| 2,520,495 | Dehn | Aug. 29, 1950 |

Cailloux teaches a pair of movable abutment arms on separate carriages along a rail acting as a common support. A pair of driving means with brakes are controlled from two boxes near the operator.

Roberts presents a safety warning system for use on a shear with a light beam and photosensor beneath the cutting blade to detect the stack-up of material sheared stock and warn the operator to prevent the back gauge from striking the stacked stock of material.

Cutter, Jr. discloses a gauge with a scale bar on the bed and a pin removably mounted on the bar. The pin is set at a distance from the bar or correspond to a hole previously punched. A hold down mechanism, also slideably mounted, engages the sheet in the region of the pin. Parts are sheared from a strip by engaging the hole of each piece in succession, or a guide bar is used to engage the edge of the strip.

Kootz uses an indexing device which prevents the droop inherent in the unsupported length of sheetmetal extending over the work edge with an inclined plane constraining the leading edge of the indexing member. A coupling allows the inclined plane member to fall out of the way as the workpiece is sheared.

Dehn takes advantage of a back gauge using a pair of vernier dials, one reading in fractions of the graduations of the other and both geared to the adjusting mechanism. The gauge setting is accomplished by rotating a hand crank which links a pair of stops operating in spaced relationship with each other.

DISCLOSURE OF THE INVENTION

The most common method of obtaining a sheared piece of material to a particular width, or a given distance from the edge to a break line, is by the use of a so-called back gauge that is built into the machine tool by the manufacturer. This gauge creates a stop when a sheet of material is placed flat into the tool. The blade shears the material between two ground faces and the material drops behind the tool in the case of a shear and positions the edge to the brake line in a press brake. This back gauge is best suited for high production work, however, it has some inherent weaknesses. As the sheet of material is layed flat on the platform and extended until it hits the stop, the material is completely unsupported and may in some cases, such as thin or narrow material, have a tendency to droop or sag. As the measurement is based on the distance from the blade or die to the stop, no allowance is made for this deformation of material as it is dependent upon many variables. Another problem in the case of a shear is while the blade is cutting the material, it does not engage the cutting surfaces all at the same time, as the blade is on a bias. In certain instances the material is forced angularly away from the table arm, ultimately changing the cut size. Another drawback is that many back gauges are mounted on the swing beam and, therefore, are subject to wear and a change in tolerance of the given dimension in time and, therefore, are not repeatable in accuracy. Due to these potential inaccuracies, a front gauge is utilized when precision shearing or forming is required relying upon a workpiece being located directly on the table and the dimension maintained by the operator manually lining the material with the stop on the front.

The invention is, therefore, directed to this approach and it is a primary object of the invention to provide a gauge that is positive in its adjustment and repeatable with no rotating motors, gears, or complex electronics that may wear or malfunction relative to the accuracy. The invention does not rely upon the table side arm of the tool at all which may be out of square to the blade or die, instead two arms are utilized with the workpiece registering on the ends of each, eliminating the out of square and unparallel condition completely.

An important object of the invention provides quick and easy adjustment throughout the entire range of sizes. This is accomplished by manually depressing a lever and sliding the invention along each of a pair of arms to a specified dimension in whole numbers marked on the arm, and making the final fractional adjustment by rotating a knob and reading the dimension on a dial indicator. As an example, if the desired dimension was 7.250 inches (or millimeters) the apparatus would be set at the 7, as marked on the arm, and the knob would be adjusted on the positive side of the scale of the dial indicator. Since all adjustments are transmitted through solid, rigid structure, the ultimate accuracy may be maintained to the highest degree of exactness.

Another object of the invention allows the workpiece to be in the front where it is easily accessible for verification of dimensions, squareness, and pressure on each gauge stop.

Still another object of the invention is its intuitive ease of understanding of the operation. Since the entire device is mechanical, the procedures of function are easily understood without elaborate manuals or training required. This simplicity of design creates a reliable and long lasting system and the few moving parts are easy to replace.

Yet another object of the invention deals with its ease of manufacture using known time-proven manufacturing techniques and a measurement device that is well known in the art, commonly available and easy to replace.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 1 is a partial isometric view of the preferred embodiment mounted upon a machine tool shear.

FIG. 2 is a cross-sectional view taken along lines 2—2 of FIG. 3.

FIG. 3 is a partial isometric cut-away view of the arm having the mounting bracket on the end removed from the tool for clarity.

FIG. 4 is a partial isometric cut-away view of the arm having the mounting bracket on the bottom removed from the tool for clarity.

FIG. 5 is a cross-sectional view taken along lines 5—5 of FIG. 4.

BEST MODE FOR CARRYING OUT THE INVENTION

Figure 6:
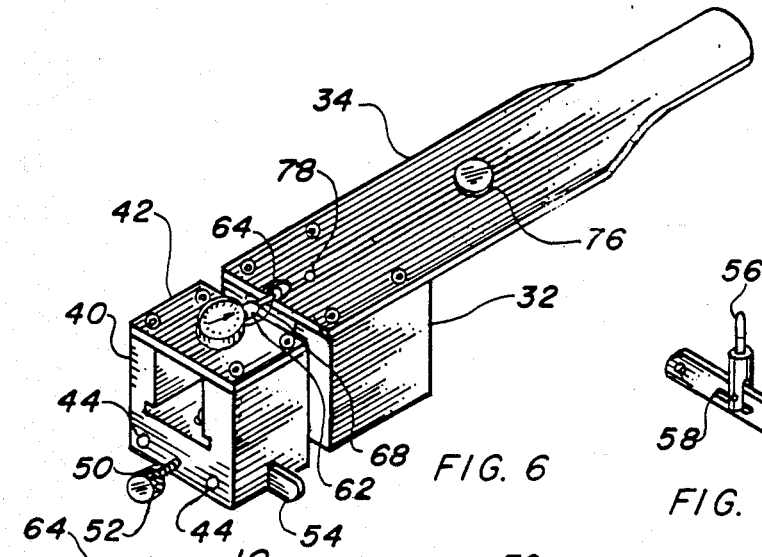
FIG. 6 is partial isometric view of the front and rear head completely removed from the invention for clarity.
Figure 7:
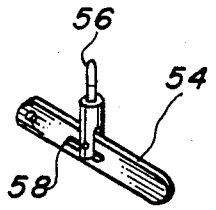
FIG. 7 is a partial isometric view of the lever and arm engaging pin assembly completely removed from the head.
Figure 8:
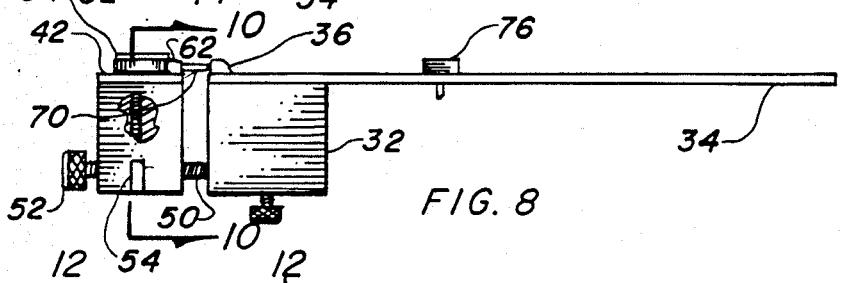
FIG. 8 is a side elevational view of the preferred embodiment.
Figure 9:
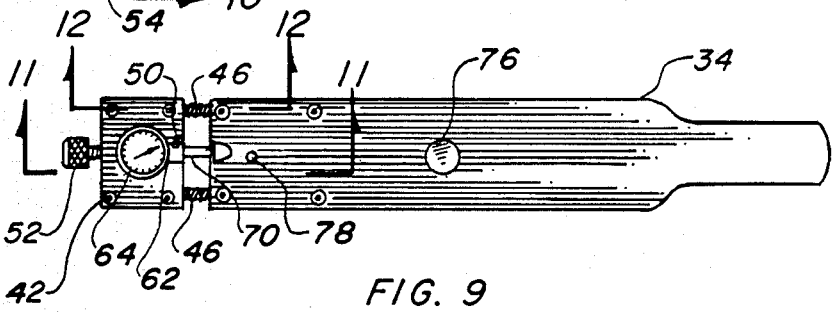
FIG. 9 is a plan view of the preferred embodiment.
Figure 10:
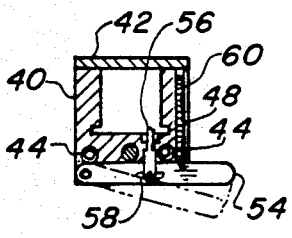
FIG. 10 is cross-sectional view taken along lines 10—10 of FIG. 9.
Figure 11:
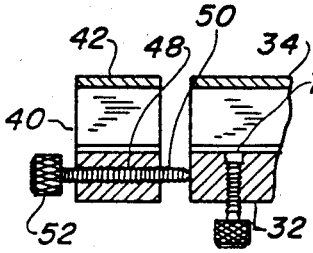
FIG. 11 is a cross-sectional view taken along lines 11—11 of FIG. 9.

The best mode for carrying out the invention is presented in terms of a preferred embodiment. The preferred embodiment, as shown in FIGS. 1 through 12 is comprised of a pair of support arms 20 that are removably joined to the front of a machine tool and provide an extending mounting surface. These support arms 20 have a plurality of equally spaced holes 22 in the bottom and are shown in FIG. 1 assembled to the tool and alone in FIGS. 3 and 4. Each arm 20 consists of a pair of vertical side members 24 in parallel relationship with a spacer 26 positioned in between forming an H-section. A foot plate 28 is attached to the bottom completing the cross-section in the form of a box. This foot plate 28 is wider than the sides and overhangs, equally forming a mounting flange, also the holes 22 are located off center. The spaced relationship between these holes is one-inch for domestic units and one centimeter, or the like, for those using the metric scale. Indica in the form of a whole number is permanently marked on one or both of the side members 24 in relation to each hole 22. This marking 23 may be stamped into the member, engraved, etched, etc., or may have a secondary marking strip added to the top surface having the indica imprinted, raised, silk screened, or marked by other methods well known in the art. Mounting of the arms 20 is accomplished in one of two forms. The first embodiment is illustrated in FIGS. 1 and 3 with a mounting bracket 30 attached to the arm 20 at one end forming a right angle on each side, allowing the arm 20 to be mounted directly to the "T" slot of the machine tool. The second embodiment is shown in FIG. 4 and is mounted on the top of the table of the tool with the bracket 30 underneath at a right angle. This arrangement also uses the "T" slot in the machine tool, but the arm 20 is on top of the work table to correspond in height with integral support plates of the tool when they are in use.

Figure 12:
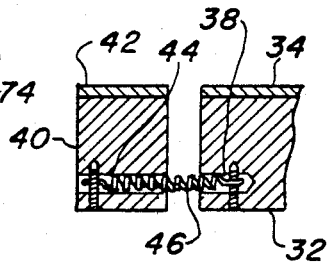
FIG. 12 is a cross-sectional view taken along lines 12—12 of FIG. 9.

Slideably attached to each arm is a pair of dissimilar but related heads. The front head 32, illustrated in FIGS. 6 through 12, is formed of a block of metal, steel, aluminum, or the like, and is rectangular in shape with an opening cut into the top half slightly larger, but of the same shape as that of the support arm 20. An arm indexing member 34 is attached to the top and extends forward toward the press in application and forms the top of the opening. This allows the indexing member 34 to be juxtaposed and slideably contiguous with the arm. The indexing member 34 is of the same width as the head 32 and is formed with narrowed portion and a radius on the extended end acting as a stop. A dial indicator arm 36 is attached on the top of the head at the end away from the tool, and is parallel to the top surface. This arm 36 is configured as a simple angle with a flat surface planar with the end of the head 32 and is attached with a threaded fastener and a pin, or the like. A pair of bores 38 for housing and attaching springs are located in the end away from the tool below the opening for the arm 20. These bores 38 are best illustrated in FIG. 12.

A rear head 40 is of the same basic shape as the front head 32, except is not as long, and the indexing member 34 is replaced with a cover 42. A pair of through bores 44 are located in the head 32 in alignment with the bores 38 in the front head when the two are mated together. A pair of biasing tension springs 46 are contained within the bores 38 and 44, as shown in FIG. 12, and are attached on the loop ends with a screw, pin, cotter key, or the like. This arrangement pulls the heads 32 and 40 together under spring tension when the pair are mounted upon an arm 20. The rear head 40 further contains a threaded hole 48 therethrough beneath the opening for the arm 20 and parallel to the arm. A positioning screw 50 having a knob 52 on one end is threadably engaged into this hole 48. Any type of conventional thread may be utilized in the hole 48 and screw 50, however, it is preferred to employ a so-called acme thread. The knob 52 extends from the end opposite the machine tool and the other end of the screw 50 rotatably embraces the front head 32. This arrangement provides a linear separation of the heads 32 and 40 when the knob 52 is manually rotated and the springs 46 maintain contact with the screw 50 and the front head 32 during both the widening and narrowing of the gap separating the heads. This adjusting means allows the gap to be regulated as governed only by the length of the screw 50. In the preferred embodiment this distance is one-inch (2.54 cm), or in a metric apparatus one centimeter, or the like. This linear separation allows a fractional adjustment to be made in setting the front gauge relative to the workpiece.

Positioning means integral with the rear head 40 allow the head to be manually slid upon the arm 20 the desired distance from the working surface of the machine tool. This is accomplished by using the holes 22 in the foot plate 28 of the arm 20 in conjunction with positioning means on the head 40. These elements are shown removed from the invention in FIG. 7 and in cross-section in FIG. 10 and consist of a manual lever 54 that is pivotally disposed within the rear head 40 and extends on one side. Drivingly connected to the lever 54 is an arm engaging pin 56 that is also contained within the head 40 and is in alignment with the holes 22 in the arm 20. This pin 56 is cylindrical in shape with one end stepped smaller in diameter terminating with a radius and the other having a slot 58 therethough. The pin 56 penetrates through the head in alignment with the holes 22 at the bottom of the opening for the arm 20 and is also attached with a roll pin, or the like, to the lever 54. An extension spring 60 attaches to the lever 54 on one end and is affixed to the head 40 through a clearance hole therein on the other. The lever 54 is pivotally mounted to the head 40 on one end with the spring 60 maintaining a contiguous relationship. As the pin 56 is attached to the lever 54, in this spring loaded position, a positive engagement is provided with one of the holes 22. When the lever 54 is manually rotated downward against the spring pressure, disengagement occurs and allows the heads 32 and 40 to slide freely upon the arm 20.

Indicating means are integral with the rear head 40 and consist of a dial indicator holder 62 fastened to the top of the head containing a dial indicator 64. The holder 62 is in the form of boss or angled with a slotted cavity 68 having a screw, or the like, providing a compressible adapter for the mounting housing of the dial indicator. The dial indicator 64 is inserted into the cavity 68 of the holder 62 with the face positioned upwardly, as shown in FIG. 6, and compressibly locked into place around the housing. The spindle 70 of the dial indicator 64 is positioned linear with the arm 20 and touches the indexing member 34 of the front head 32 allowing the linear distance between the heads to be accurately read.

In order to prevent accidental adjustment or movement of the front head 32 away from rear head 40, a locking screw 72 is located in the underside of the front head 32 within a threaded, counterbored hole. This locking screw 72 contains a knurled knob on one end and a brass stop 74 is placed within the counterbored portion of the threaded hole contiguous with the other end. When the adjustment is made, the screw 72 is rotated urging the stop 74 into compression against the arm 20, creating a positive locking condition. For material larger than the total length of the arm 20, less the length of the indexing member 34, a separate indexing pin 76 is utilized in conjunction with a pair of indexing bores 78 in the member 34. In operation the assembly is adjusted to the maximum dimensional position and the pin 76 is placed in the bore 78, marked with indica 23, which is either 10 or 20 increments apart. The material is placed over the top of the member 34 until it impinges on the periphery of the pin 76, creating the stop and the head 32 is adjusted in the usual manner. The pin 76 is shown mounted into the member 34 in FIGS. 8 and 9.

In operation the arms 20 are attached to the machine tool and the front and rear head assemblies are slid into place upon the arms. The lever 54 is depressed allowing the heads to be moved to the desired dimension, as indicated on the arm to the nearest whole number. The lever 54 is released and the pin 56 spring loads into the selected hole 22. The knob 54 of the screw 50 is rotated separating the heads to the desired fractional number, as displayed on the face of the dial indicator 64. A workpiece in the form of flat sheet material is placed on the table of the machine tool so as to touch the radial ends of the indexing member 34 and the shear blade or die is depressed cutting or forming the workpiece at the desired dimension. If angular cuts or locations are required, the same procedure is followed, except the heads are adjusted independently.

The preferred embodiment utilizes a pair of arms 20 and head assemblies which are exact duplicates, however the levers 54 on the heads may be opposite hand for convenience of the operator. Single units may also be used in special applications in conjunction with the side stops of the tool.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the appended claims.

I claim:

1. A front position locating gauge for a machine tool comprising:

(a) a support arm having a plurality of equally spaced holes therewithin, removably joined to the front of the machine tool providing an extended mounting surface;

(b) a front head having means to slide on said arm and an indexing member extending therefrom, the head slideably engaging the arm providing a stop on the end of he indexing member a linear alignment with the arm; said front head further having a dial indicator arm fastened to the top of the head providing a uniform measurable surface for engaging the indicating means;

(c) a rear head having means to slide on said arm, adaptably communicable with the front head for sliding on the arm in concert therewith;

(d) positioning means integral with said rear head decisively engaging a selected hole in the arm providing a predetermined location of the heads relative to the tool processing member;

(e) adjusting means joining the front and rear heads in a manual yielding manner within a fixed increment of measure allowing a precise distance from one head to the other to be generated; and, (f) indicating means integral with the rear head and contiguously engaging the front head for reading the linear distance therebetween, the gauge providing an adjustably precise distance between the end of the indexing arm and the machine tool by positioning the rear head using the nearest hole in the arm for the approximate location and making the final locational adjustment by sliding the front head to the exact position as verified by the indicating means.

2. The invention as recited in claim 1 wherein said rear head further comprises: a dial indicator holder fastened to the top of the head having compressible mounting means for supporting the indicating means therewith.

3. The invention as recited in claim 1 wherein said positioning means further comprise:

a manual lever pivotally disposed within the rear head, and extending on one side, an arm engaging pin drivingly connected to the lever and contained within the rear head in such a position as to align with the holes in the arm when the lever is contiguous with the head and disengaged when the arm is rotated axially therefrom, and, a lever tension spring embracing the lever and joined to the rear head in such a manner as to define an engaged position held under the influence of the spring.

4. The invention as recited in claim 1 wherein said adjusting means further comprise:

a pair of biasing tension springs contained within both the front and rear heads urging the heads together, and, a positioning screw having a knob on one end threadably engaged through the entire rear head with the knob distended from the rear and the other end embracing the front head in such a manner as to provide a linear separation of the heads under spring tension when the positioning screw is rotated by the knob.

5. The invention as recited in claim 1 wherein said indicating further comprise: a dial indicator of a type that includes a face and an integral mounting housing which is planar with the dial indicator face and incorporates an extended spindle. the face and a spindle extending therethrough.

6. A front position locating gauge for a machine tool comprising:

(a) a support arm having a plurality of equally spaced holes therewithin, removably joined to the front of the tool providing an extended mounting surface;

(b) a front head having means to slide on said arm and an indexing member extending therefrom, the head slideably engaging the arm providing a stop on the end of the indexing member in linear alignment with the arm;

(c) a rear head having means to slide on said arm, adaptably communicable with the front head for sliding in concert therewith on the arm;

(d) positioning means integral with said rear head decisively engaging a selected hole in the arm providing a measured location of the heads relative to the tool processing member, said positioning means further comprising, a manual lever pivotally disposed within the rear head, and extending on one side, an arm engaging pin drivingly connected to the lever and contained within the rear head in such a position as to align with the holes in the arm when the lever is contiguous with the head and disengaged when the arm is rotated axially therefrom, and, a lever tension spring embracing the lever and joined to the rear head in such a manner as to define an engaged position held under the influence of the spring.

(e) adjusting means unitizing the front and rear heads in a manual yielding manner within a fixed increment of measure allowing a precise distance from one head to the other to be generated said adjusting means further comprise, a pair of biasing tension springs contained within both the front and rear heads urging the heads together, and a positioning screw having a knob on one end threadably engaged through the entire rear head with the knob distended from the rear and the other end embracing the front head in such a manner as to provide a linear separation of the heads under spring tension when the screw is rotated by the knob, and, (f) indicating means integral with the rear head and contiguously engaging the front head for reading the linear distance therebetween, the gauge providing an adjustably precise distance therebetween the end of the indexing arm and the machine tool by positioning the rear head using the nearest hole in the arm and making the final adjustment by sliding the front head to the exact location as verified by the indicating means.

* * * * *